US006512431B2

(12) United States Patent
Pergande

(10) Patent No.: US 6,512,431 B2
(45) Date of Patent: Jan. 28, 2003

(54) MILLIMETERWAVE MODULE COMPACT INTERCONNECT

(75) Inventor: Albert Pergande, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/794,066

(22) Filed: Feb. 28, 2001

(65) Prior Publication Data

US 2002/0118083 A1 Aug. 29, 2002

(51) Int. Cl.[7] ..... H01P 5/08
(52) U.S. Cl. ..... 333/246; 333/66; 333/24 R
(58) Field of Search ..... 333/246, 24 R, 333/33, 26, 260

(56) References Cited

U.S. PATENT DOCUMENTS

| | | | | |
|---|---|---|---|---|
| 3,176,275 A | * | 3/1965 | Gribble et al. | 333/24 R |
| 3,771,075 A | * | 11/1973 | Phelan | 333/24 R |
| 4,490,721 A | | 12/1984 | Stockton et al. | |
| 4,771,294 A | | 9/1988 | Wasilousky | |
| 5,073,761 A | | 12/1991 | Waterman et al. | |
| 5,132,648 A | | 7/1992 | Trinh et al. | |
| 5,218,373 A | | 6/1993 | Heckaman et al. | |
| 5,235,300 A | | 8/1993 | Chan et al. | |
| 5,363,075 A | | 11/1994 | Fanucchi | |
| 5,545,924 A | | 8/1996 | Contolatis et al. | |
| 5,633,615 A | | 5/1997 | Quan | |
| 5,694,134 A | | 12/1997 | Barnes | |
| 5,703,599 A | | 12/1997 | Quan et al. | |
| 5,754,948 A | | 5/1998 | Metze | |
| 5,808,530 A | | 9/1998 | Kalonji et al. | |
| 5,832,598 A | | 11/1998 | Greenman et al. | |
| 5,852,391 A | | 12/1998 | Watanabe et al. | |
| 5,982,250 A | | 11/1999 | Hung et al. | |
| 5,990,768 A | | 11/1999 | Takahashi et al. | |
| 6,023,210 A | | 2/2000 | Tulintseff | |
| 6,064,286 A | | 5/2000 | Ziegner et al. | |

* cited by examiner

*Primary Examiner*—Benny Lee
*Assistant Examiner*—Kimberly E Glenn
(74) *Attorney, Agent, or Firm*—Burns, Doane, Swecker & Mathis, LLP

(57) ABSTRACT

The present invention is generally directed to an interconnect structure, which in accordance with exemplary embodiments, includes a first layer and a second layer for connecting an integral first signal path with a second signal path. The first layer can have a first conductor and a slot. The second layer can be positioned to be in operable communication by an opening between the first layer and the second signal path such that a distance from the first signal path to a second surface of the second layer establishes an evanescent mode of signal propagation.

24 Claims, 8 Drawing Sheets

MILLIMETERWAVE MODULE COMPACT INTERCONNECT

BACKGROUND

1. Filed of the Invention

The present device relates generally to an interconnect for electronic packaging technology. More specifically, the device relates to interconnecting modules to pass millimeterwave signals.

2. Background Information

Present millimeterwave (MMW) interconnection structures are very labor intensive to construct and inspect. For larger millimeterwave systems having thousands of elements, the labor cost often becomes prohibitive for all but advanced military applications. Even with modern automated assembly equipment, the construction time is affected by the precise and complex interconnect systems used today. Precision connectors are large and costly, and use of wire bonds for jumpers is often impractical, and individual modules may not be replaced easily.

Efficient and low cost interconnection, as for example with MMIC chips, is a major challenge for successful module performance. This may be especially challenging in high frequency, large array applications. Modules tend to become quite small at higher frequencies and the connection of individual chips should preserve transmission line quality (i.e., maintain transmission line impedances and avoid discontinuities causing reflections) and should be short to minimize unnecessary time delays in processing the signals.

For example, advanced phased array applications generally dictate a very large number of antenna elements in the array to support high gain or large directivity requirements. In a typical application for extremely high frequency (EHF) 30–300 GHz antennas, a given array can include 3000–5000 elements interspersed in a periodic array. In an active aperture, array elements are associated with each of the antenna elements. The large number of antenna elements and their close spacing requires high density interconnection of the MMIC chips. For example, spacings on the order of 0.25 to 1 wavelength translate to 0.75 to 3.0 millimeters at 94 GHz.

In conventional techniques, precision hand-work is required for connecting gold ribbon, bond wire, or coaxial cables to each contact pad. In addition, free volume or space is required to accommodate wires as they are fed around the edges or over the surface of each MMIC for connection to other apparatus. An alternative is to use large diameter passages extending through the MMIC which allow for the passage of small cables or wires through the MMIC for connection to other apparatus. This consumes additional MMIC surface area and affects element spacing.

Current MMIC arrays also tend to be customized structures with variations in reliability and performance characteristics. Exact power requirements, channel cross-talk, and packaging vary from array to array. This lack of reproducibility and manufacturing consistency prevents wider application of MMIC arrays.

To transmit radiated energy between modules, several technologies are currently used. A microstrip launch with a backshort or "dog house" type cover can be used. The cover provides the required waveguide backshort termination and mode filter. A narrow microstrip channel formed in the microstrip substrate helps to prevent waveguide mode leakage. Since this launcher must be at least a half wavelength long, there is a limit to how small it may be.

Another technology used to transmit radiated energy is a waveguide. Waveguide connectors usually bolt together at their flanges, and generally require an inside width of at least $\lambda/2$ to transmit a signal (where $\lambda$ is the wavelength of the signal to be transmitted). A waveguide connector requires a balun, i.e., a network for the transition from an unbalanced transmission line to a balanced transmission line, having a transition length of $\lambda/4$. Consequently, a waveguide connector may be relatively large.

A connection to a microstrip lead, e.g., a transmitter/receiver module, can be made by transition to a stripline (e.g., press mating), a coaxial connector, or a microstrip wire bonded to another circuit. Press mating a stripline lead to another stripline generally requires a secondary soldering step to ensure adequate transmission line connectivity under any sort of vibration or temperature cycling. The performance of coaxial connectors deteriorates over time and after repeated connections due to mechanical wear. Hermetic coaxial ports used for transmitting radiated energy are generally very small. Hence, the coaxial glass seals, which themselves are difficult to assemble and bond, must be soldered to the housing wall in a time consuming, labor intensive, and costly process. Wire bonding, press mating, and use of coaxial connectors results in bulky connections that involve contact complexity. These connections, except for the coaxial connector, require connection in a plane parallel to the plane of the substrate of the radio frequency microstrip circuit. Thus, these known interconnects are unsuited for use as a millimeterwave interconnect to couple modules where the modules may have to mate to a back plane at a 90° angle, such as in a large phased array.

U.S. Pat. No. 5,545,924 to Contolatis et al., the disclosure of which is herein incorporated by reference, provides for a three dimensional interconnect package for monolithic microwave/millimeterwave integrated circuits. However, Contolatis et al. relies upon conductor lines that are soldered together or otherwise connected, such as with wirebonding.

U.S. Pat. No. 5,235,300 to Chan et al., the disclosure of which is herein incorporated by reference, discloses packaging for millimeterwave or microwave devices. The unpackaged devices are placed in a cavity and hermetically sealed. Interconnects are then provided with a microstrip to strip line to microwave probe transition. However, the interconnects and transition are full size waveguide transitions.

U.S. Pat. No. 5.132.648 to Trihn et al., the disclosure of which is herein incorporated by reference, discloses a very large array feed-through assembly. A complex multilayer module incorporates the housing and interconnect functions for the circuit. Vias are filled with conductive metallic materials and are relied upon for signal routing and off-chip signal transfer.

U.S. Pat. No. 5,218,373 to Heckamen et al., the disclosure of which is herein incorporated by reference, discloses a device in which the propagation of signal radiation occurs through a glass window into an air dielectric waveguide. The launching of the radiation is provided by a conventional launch probe via induction through a hermetically sealed dielectric window. A periodic, waffle shaped wall structure functions to route the signal around the mounting board.

U.S. Pat. No. 5,073,761 to Waterman et al., the disclosure of which is herein incorporated by reference, discloses a non-contact interconnect in which capacitive coupling is utilized to improve the connection's performance. Additionally, one-quarter wavelength long lines are employed in the coupling, thus dictating the minimum size of the interconnect.

SUMMARY

The present invention is generally directed to an interconnect structure, which in accordance with exemplary embodiments, includes a first layer and a second layer for connecting an integral first signal path with a second signal path. The first layer can have a first conductor and a slot. The second layer can be positioned to be in operable communication by an opening between the first layer and the second signal path such that a distance from the first signal path to a second surface of the second layer establishes an evanescent mode of signal propagation. The evanescent mode is only required to propagate a very short distance, and thus introduces negligible attenuation and reflection.

The interconnect structure provides a rugged, compact interconnect that can be configured substantially smaller than a waveguide, compatible with existing MMIC assembly methods, repeatedly and easily connected and disconnected, and can allow easy test fixturing for modules.

BRIEF DESCRIPTION OF THE DRAWING FIGURES

Objects and advantages of the invention will become apparent from the following detailed description of preferred embodiments in connection with the accompanying drawings, in which like numerals designate like elements and in which.

DETAILED DESCRIPTION OF THE PREFERRED EMBODIMENTS

Figure 1:
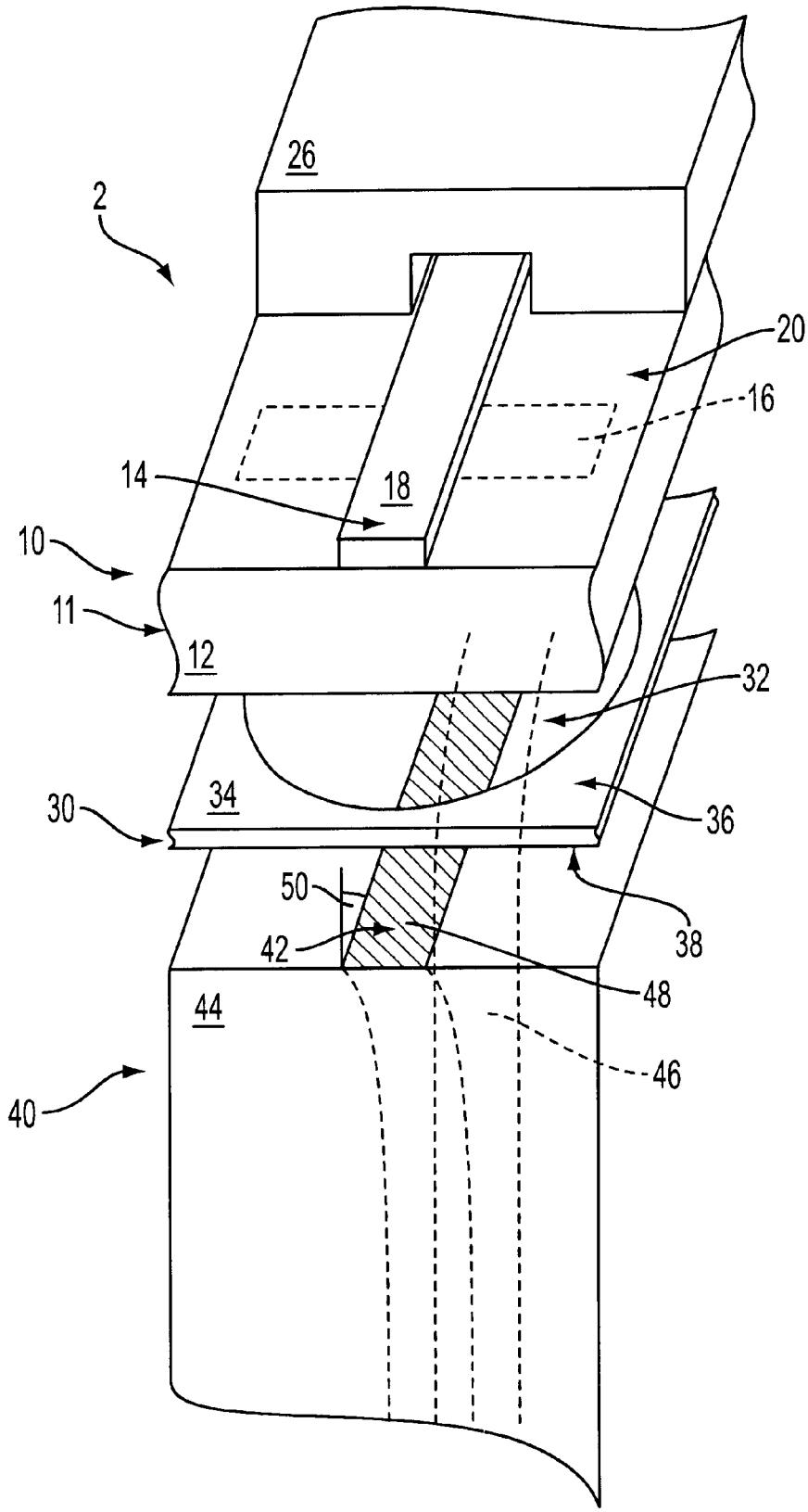
FIG. 1 is an exploded perspective view of an interconnect structure.

FIG. 1 is a perspective view of an exemplary interconnect structure 2 in which the interconnection occurs through induced electromagnetic (EM) fields. An exemplary interconnect structure 2 connects an integral first signal path 10 with a second signal path 40, such as a first signal path conductor 14 and a second signal path waveguide 46. The interconnect structure 2 includes a first layer, such as a dielectric layer 12, having a first conductor 14 and a slot 16 on a first surface 24; a second layer such as a base 30, a first surface 36 in operable communication with the first surface 24 of the first layer, a second surface 38 communicating with a second signal path 40, and an opening 32 for signal propagation between the first signal path 10 and the second signal path 40. The distance from the first signal path 10 to the second surface 38 of the second layer establishes an evanescent mode of signal propagation.

Figure 2:
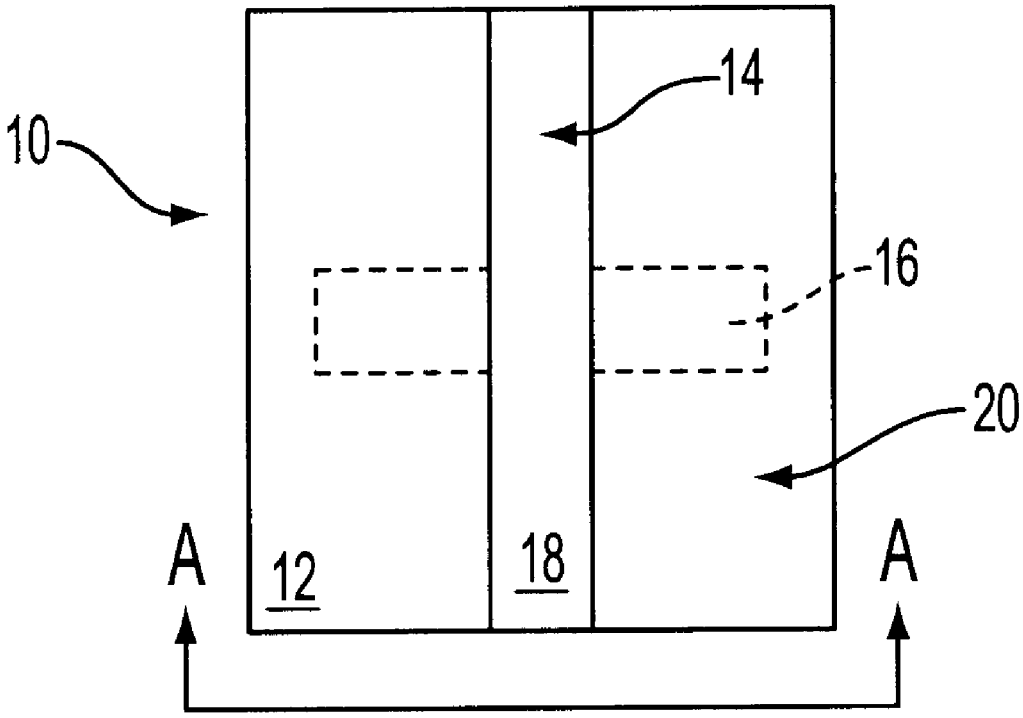
FIG. 2 is a first embodiment of a microstrip substrate.
Figure 3:
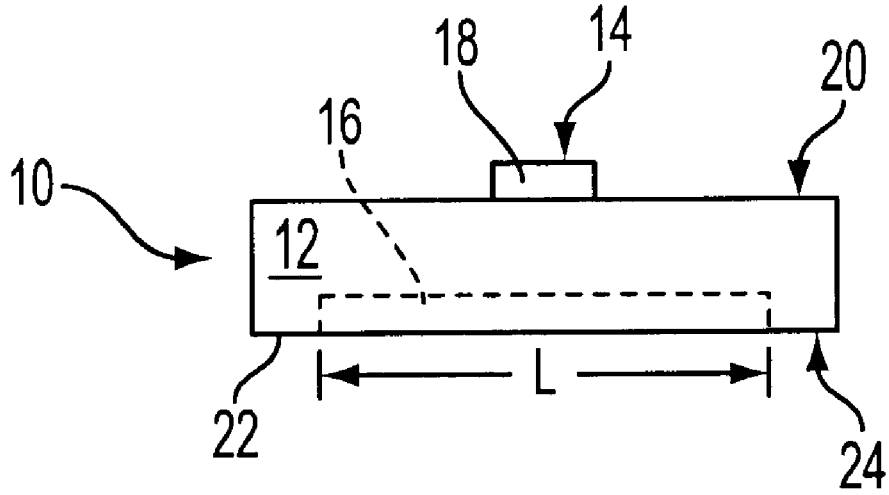
FIG. 3 is an end view of the microstrip substrate of FIG. 2 as seen along AA.
Figure 4:
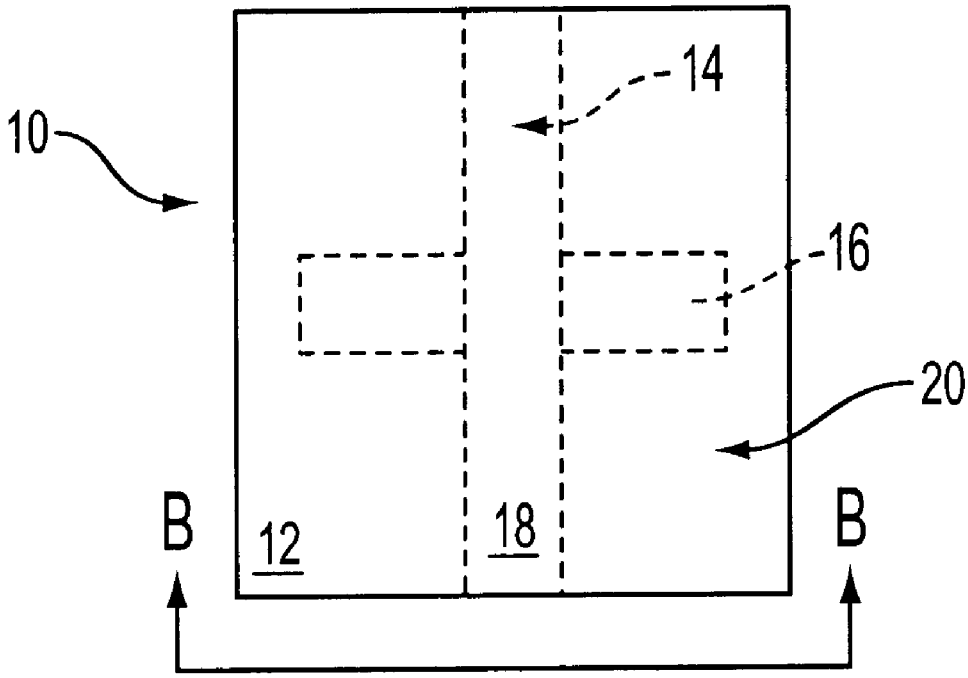
FIG. 4 is an additional embodiment of a microstrip substrate.
Figure 5:
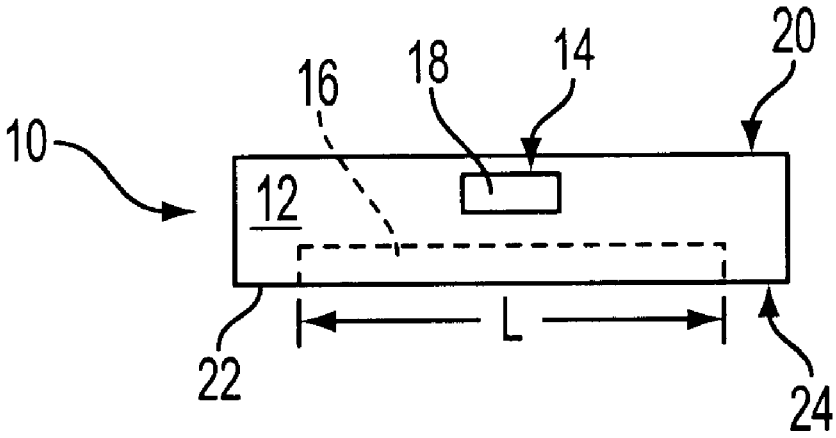
FIG. 5 is an end view of the microstrip substrate of FIG. 4 as seen along BB.

Referring again to FIG. 1, an exemplary interconnect structure 2 can be a microstrip to slot assembly 11 that has a dielectric layer 12, a first conductor 14 and a slot 16. A first embodiment of a microstrip to slot assembly 11 is shown. A first conductor 14 can be a microstrip line 18 on a second surface 20 of a dielectric substrate 12 and can pass over a slot 16 in a ground plane 22 ,the ground plane 22 being on the first surface 24. Further details are shown in FIGS. 2 and 3. An alternative embodiment of a microstrip to slot assembly 11 places the first conductor 14 in the interior of the dielectric layer 12 and is illustrated in FIGS. 4 and 5.

The slot 16 is a shaped cavity extending from the first surface 24 into the body of the dielectric 12. The slot length L is a minimum of one quarter wavelength ($\lambda$) long ($L \leqq \lambda/4$) in the effective dielectric, which is less than the free space half-wavelength by a factor of about $\sqrt{((E_r+1)/2)}$. For Alumina, $E_r=9.6$, the slot would be about 0.2 of a wavelength. Therefore, the higher the dielectric constant ($E_r$) of the substrate 12, the shorter the slot length L, and the closer individual interconnect structures 2 may be positioned to each other.

The slot 16 need not be rectangular in shape. It can be any opening in the metal ground plane, up to the size of the hole 32. Larger holes may have less inductance, which is normally a more desirable situation. Other examples of shapes for a slot 16 include bowties and dog bone shapes.

Figure 6:
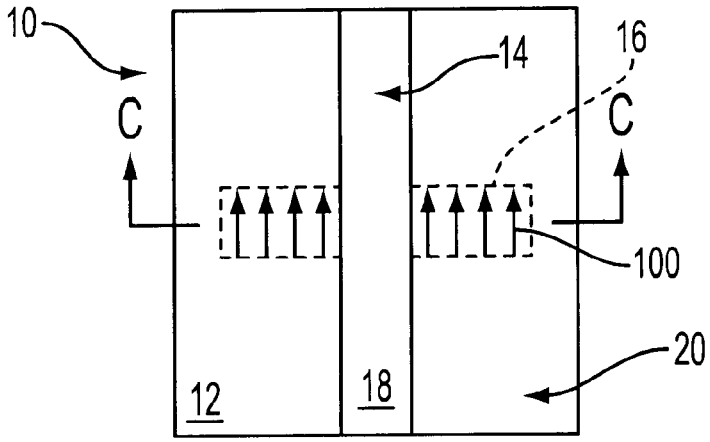
FIG. 6 is a depiction of the electric field lines present in the slot of the microstrip substrate of FIG. 2.
Figure 7:
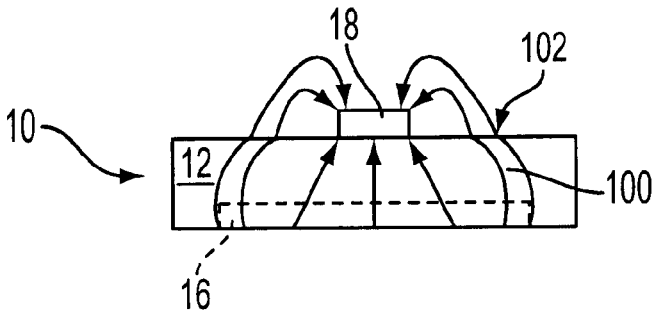
FIG. 7 is a depiction of the electric field lines present in the microstrip line of the microstrip substrate of FIG. 6 as seen along CC.
Figure 8:
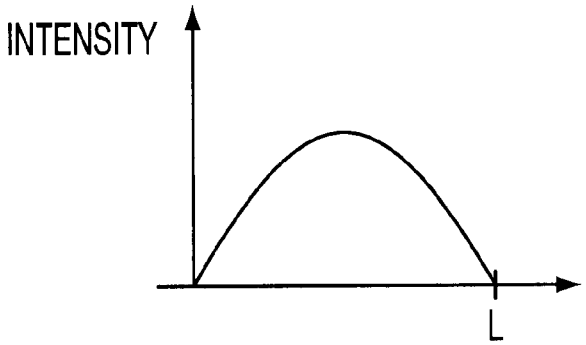
FIG. 8 is a representation of the intensity of the electric field in the slot of the microstrip substrate of FIG. 6.

As seen in FIG. 6, the electric field lines 100 in the microstrip to slot assembly 11 exist across the narrow dimension of the slot 16. The intensity of the electric field in the slot 16 is a sinusoidal wave, as represented in FIG. 8. FIG. 8 shows that the highest intensity of the electric field is toward the center of the slot length L and corresponds to the position of the microstrip line 18 in the depicted embodiment. The electric field lines 100 in the microstrip line 18 are shown in FIG. 7. Note the discontinuity 102 when the filed lines 100 pass from the dielectric substrate 12 to air.

If it were suspended in free space, the microstrip to slot assembly 11 would act as an antenna element, radiating most of its energy toward the microstrip line 18. A backshort 26 placed over the microstrip line 18 of the microstrip to slot assembly 11, compels the energy to flow in the direction of the slot 16.

The microstrip to slot assembly 11 is attached to a base 30 with an opening 32 under the slot 16, and a backshort 26 over the top. In the embodiment pictured, the base 30 is a metal base 34. The metal base 34 may be constructed from aluminum, brass, or other suitable material. The base 30 has an opening 32 for signal propagation which extends through the base 30 from a first surface 36 to a second surface 38. The opening 32 provides for signal communication between the first signal path 10, such as a first conductor 14 of the microstrip to slot assembly 11, and the second signal path 40. The width of the base 30 is sufficiently small to allow for signal propagation between the first conductor 14 of the microstrip to slot assembly 11 and the second signal path 40 by an evanescent mode of the signal.

The opening 32 under the slot 16 may be smaller than the normal dimension of the waveguide appropriate to this frequency. Since the base 30 is quite thin, it acts as an inductive or capacitive iris, depending on its dimensions and aspect ratio. The thickness of the slot is related to the signal frequency. Typically, a metal backshort may be on the order of one-tenth of a wavelength ($\lambda/10$) in free space or less and may be an inductive or capacitive iris. In general, the backshort 26 above the opening 32 is of the same planar dimension as the opening 32. The depth of the backshort 26 and the dimensions of the iris, along with the dielectric substrate 12, form a resonant circuit. The opening 32 may have any shape, so long as the capacitance or inductance it provides may be tuned out by the backshort 26. For example, the opening 32 for signal propagation may be an arbitrary shape with at least a major dimension corresponding to a major dimension of the slot 16 in the first surface 24 of the first layer. Other arbitrary shapes for the opening 32 for signal propagation may correspond to any one or more of the shape and position of the first signal path conductor 14, the slot 16, and the second signal path 40.

Figure 9:
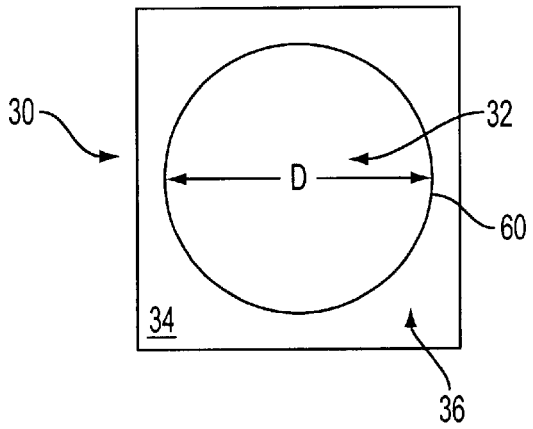
FIG. 9 is an embodiment of a base with a circular opening for signal communication.
Figure 10:
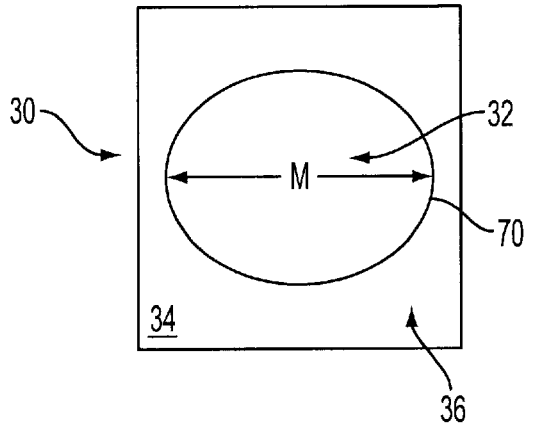
FIG. 10 is an additional embodiment of a base with an oval opening for signal communication.
Figure 11:
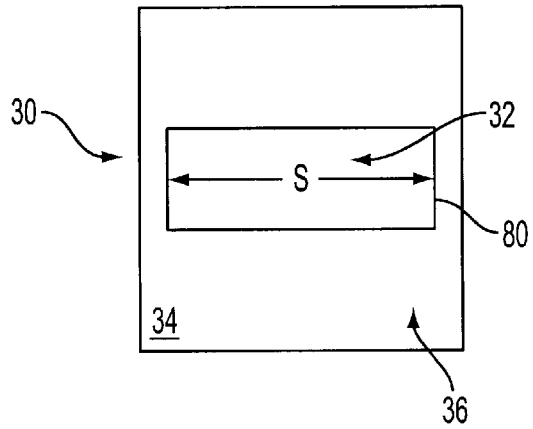
FIG. 11 is a further embodiment of a base with a rectangular opening for signal communication.
Figure 12:
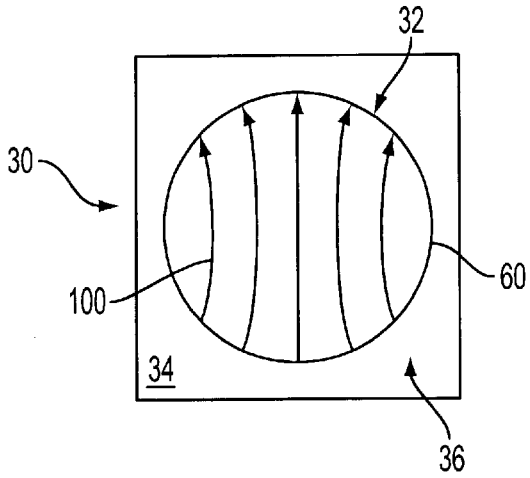
FIG. 12 is a depiction of the electric field lines present in the base with a circular opening for signal communication of FIG. 9.

A preferred shape is a circle 60 or ellipse 70, as illustrated in FIGS. 9 and 10, respectively, that may be easily made with, for example, an end mill. A parallelogram, such as a square (not shown) or a rectangle 80 as shown in FIG. 11, provides more options for reactance control, but may require more complicated manufacturing methods to produce, such as electric discharge machining or etching. In all cases, the dimension of the opening 32 is related to the length L of the slot 16. For example, for the opening 32 in the shape of a circle 60, the diameter D of the circle is related to the length L of the slot 16. Similarly, for the length M of the major axis of the ellipse 70 and the length S for the long length of the rectangle 80. The electric field lines 100 in the opening 32 for signal propagation in the illustrated geometries of FIGS. 9–11 are depicted in corresponding FIGS. 12–14.

The second signal path 40 is provided with a second conductor 42. FIG. 1 illustrates a second signal path 40 embodied as a reduced size finline assembly 44 in which a dielectrically loaded reduced height and width waveguide 46 is provided with a finline transition 48 to microstrip or coplanar waveguide. Finline is well known in the prior art, as are transitions between it and microstrip. This type of transition is usually made in full width waveguide. If the desired operating band for this interconnect is reasonably far from conventional waveguide cutoff, the dielectric loading of the finline substrate may appreciably reduce the width of the waveguide to well under the standard half wavelength at lowest frequency cutoff.

Figure 15:
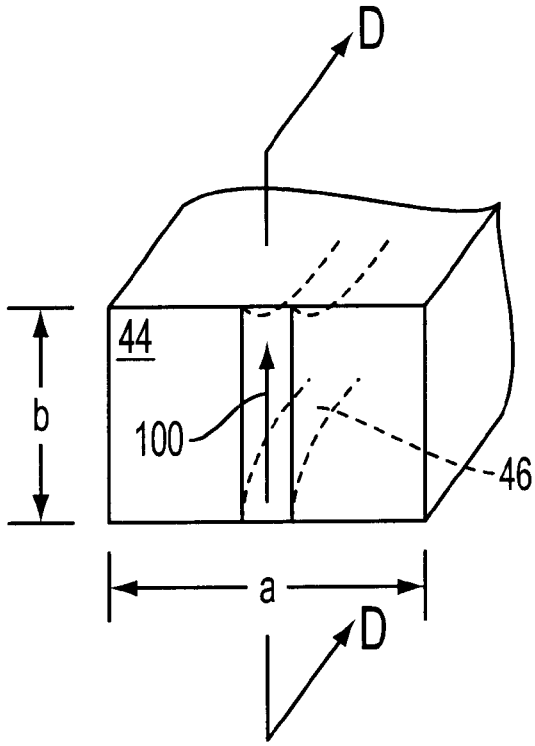
FIG. 15 is a perspective view of an embodiment of a finline.

FIG. 15 is a perspective view of an embodiment of a finline assembly 44. Normally, a dielectric substrate is positioned in a regular size waveguide. FIG. 15 depicts a reduced "a" dimension with a high dielectric loading. The high loading facilitates wave propagation within the waveguide 46. The electric field lines 100 are also shown.

Figure 16:
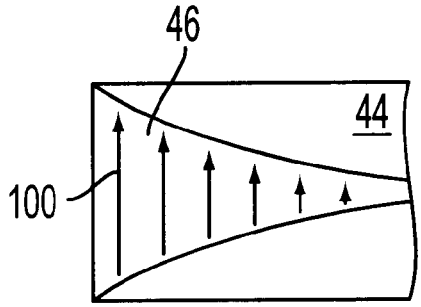
FIG. 16 is a crossectional view of the finline of FIG. 15 as seen along DD.

FIG. 16 is a crossectional view of the finline assembly 44 of FIG. 15 as seen along DD in which the electric field lines 100 are depicted. The edges of the waveguide 46 of the finline assembly 46 are reduced in slope as the waveguide 46 travels into the finline assembly 44.

The distribution of electric field lines in this reduced width waveguide may be made nearly identical to the fields produced by the microstrip to slot 10 and base 30 combination described above. Abutting the microstrip to slot assembly 11, base 30, and second signal path 40 provides a desirable method to connect signal paths. The finline to microstrip transition may occur in about one wavelength of transmission line.

As an example, a 94 GHz connector would be about 40 by 65 mils in footprint, as compared to 50 by 100 mils for a normal WR-10 waveguide. Note that the microstrip line 18 ties over the end of the finline substrate. The angle $\alpha$ 50 that would be formed by the intersection of the projections of the first conductor 14 and the second conductor 42 may be in the range of ±20° of parallel. Rotating it $\pi$° will cause it to work very poorly due to the electric fields of the two parts being crossed.

Figure 13:
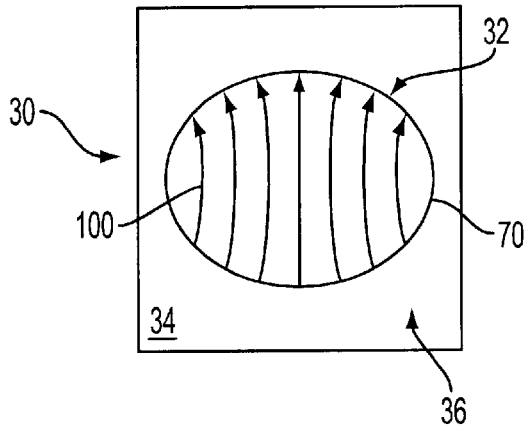
FIG. 13 is a depiction of the electric field lines present in the base with an oval opening for signal communication of FIG. 10.
Figure 14:
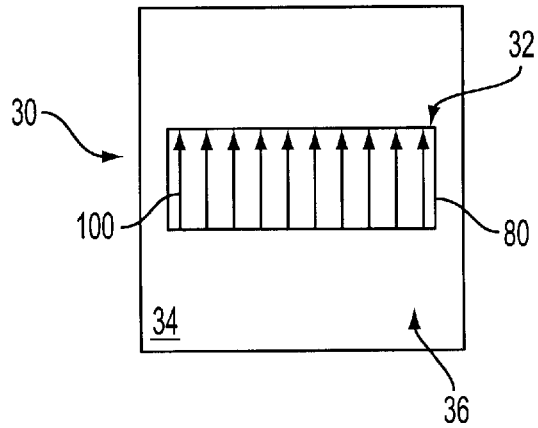
FIG. 14 is a depiction of the electric field lines present in the base with a rectangular opening for signal communication of FIG. 11.

FIG. 13 is another embodiment in which multiple interconnect structures 2 are abutted, one to the other, to form a multiple interconnect assembly 90. In contrast to interconnects with a physical connection, abutting multiple interconnect structures 2 allows for repeated connection and disconnection. This is advantageous when, for example, an assembly 2 fails and needs to be replaced. The interconnect structures are arranged such that the first conductors 14 are parallel. Additionally, the separation distance X between adjacent parallel first conductors 14 is at least three times the width W of the first conductor. This is to prevent coupling between adjacent interconnect structures 2. To complete the embodiment, multiple reduced size finline assemblies 44 are also placed abutting one another such that the dielectrically loaded finline waveguide 46 is aligned within ±20° of parallel with the corresponding first conductor 14. Physically, this will align, within ±20°, the respective electric field lines 100 of the first conductor 14 and second conductor 42. Positioned above each microstrip to slot assembly 11 is a backshort 26. The backshort 26 may be individual, as depicted in FIG. 1, or may be constructed as a multiple backshort assembly 92 as illustrated in FIG. 17.

A method to assemble an interconnect structure 2 to connect a signal path is provided. An exemplary method positions a first layer, such as a dielectric layer 12 having a first conductor 14 and a slot 16 on a first surface 24, abutting a second layer with an opening 32 for signal propagation, such as a base 30 with a first surface 36 and a second surface 38. A second signal path 40, such as a waveguide 46 with a finline to waveguide transition, is positioned to abut the second surface 38 of the base 30. The structure places a first surface 36 and a second surface 38 of the base 30 in inoperable communication with the 24 the first layer and the second signal path 40, respectively. A backshort can be positioned abutting the second surface 20 of the first layer. An example of a signal path connected by the method is a W-band signal from a back plane distribution network in an antenna array. W-band refers to the 75–110 GHz band commonly associated with a WR-10 waveguide, but the interconnect described may be utilized by any microwave frequency.

As an example, a method to assemble the interconnect structure 2 of FIG. 1 involves positioning the backshort 26 abutting a second surface 20 of the microstrip to slot assembly 11 such that the opening in the backshort is placed over the first conductor 14. The first surface 24 of the microstrip to slot assembly 11 abuts the first surface 36 of the base 32. The slot 16 in the dielectric layer 12 is aligned to the opening 32 for signal propagation. The second conductor 42 of the second signal path 40 abuts the second surface 38 of the base 30. The assembly steps place the interconnect structure 2 to be connected, for example the microstrip line 18 and the reduced size finline assembly 44, so that a signal may be propagated using an evanescent mode from the first conductor 14 to the second signal path 40.

Figure 17:
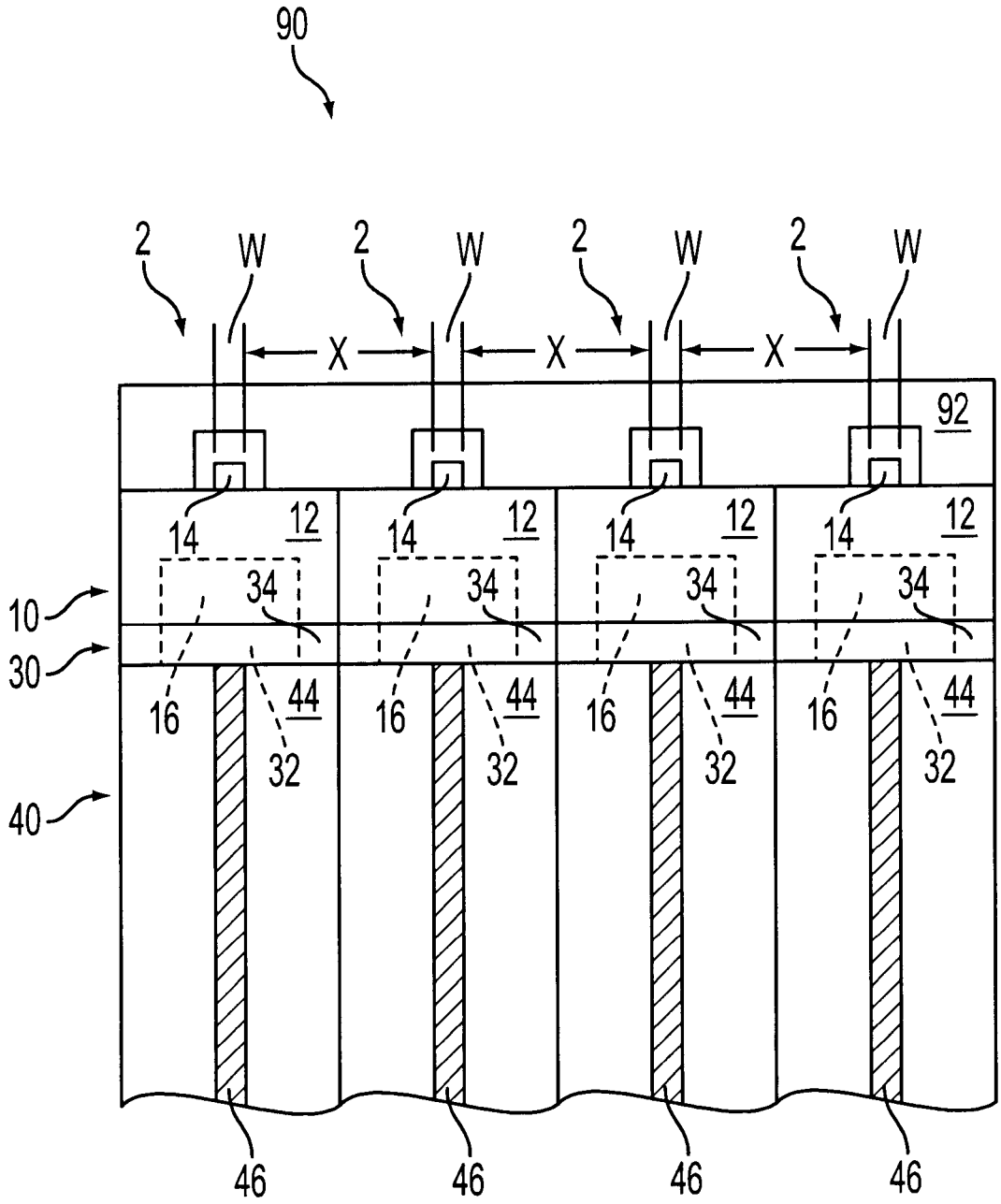
FIG. 17 is a longitudinal edge view of an assembly of multiple interconnect structures.

FIG. 17 shows a group of modules fed with a multiple interconnect assembly 90. For example, such an interconnect assembly 90 would be desirable in a microwave phased array antenna for connecting W-band signals from a back plane distribution network into the small array modules, although many other applications exist.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. An interconnect structure connecting an integral first signal path with a second signal path, the interconnect structure comprising:

a first layer, having a first conductor and having a slot on a first surface; and a second layer, having a first surface in operable communication with the first surface of the first layer, a second surface for communicating with a second signal path, an opening for signal propagation between the first signal path and the second signal path, wherein a distance from the first signal path to the second surface of the second layer establishes an evanescent mode of signal propagation, wherein signal propagation in the second signal path is at approximately right angles to the plane of the second surface.

2. The interconnect structure of claim 1, wherein the first conductor of the first layer is on a second surface of the first layer.

3. The interconnect structure of claim 1, wherein the first conductor of the first layer is interior to a second surface of the first layer.

4. The interconnect structure of claim 1, wherein the first layer is a dielectric material.

5. The interconnect structure of claim 1, wherein the slot on the first surface of the first layer has a maximum length equal to ¼of the wavelength of the frequency of a signal to be conveyed.

6. The interconnect structure of claim 1, wherein the first surface of the first layer is a ground plane.

7. The interconnect structure of claim 1, wherein a minimum dimension for the opening for signal propagation is a length of the slot on the first surface of the first layer.

8. The interconnect structure of claim 1, wherein the opening for signal propagation is a circle, the circle having a minimum diameter equal to a length of the slot on the first surface of the first layer.

9. The interconnect structure of claim 1, wherein the opening for signal propagation is an ellipse, the ellipse having a minimum length of the major axis equal to a length of the slot on the first surface of the first layer.

10. The interconnect structure of claim 1, wherein the opening for signal propagation is a rectangle, the rectangle having a minimum length equal to a length of the slot on the first surface of the first layer

11. The interconnect structure of claim 1, wherein the opening for signal propagation is an opening with at least a major dimension corresponding to a major dimension of the slot in the first surface of the first layer.

12. The interconnect structure of claim 1, further comprising a backshort, the backshort abutting the second surface of the first layer.

13. The interconnect structure of claim 12, wherein the opening for signal propagation is an opening that has a capacitance or inductance that is tuned out by the backshort.

14. The interconnect structure of claim 1, wherein the second signal path is a finline assembly.

15. The interconnect structure of claim 1, wherein the projections of the first conductor and the second signal path intersect at an angle $\alpha$, where $\alpha$ is in the range $0\pm20°$.

16. The interconnect structure of claim 15, wherein $\alpha$ is in the range 80–100°.

17. The interconnect structure of claim 1, wherein an electric field of the first conductor aligns with an electric field of the second signal path.

18. The interconnect structure of claim 1, wherein the second layer is a waveguide or a microwave structure.

19. The interconnect structure of claim 1, wherein the first conductor is aligned within ±20° of parallel with the second signal path.

20. A method of connecting a first signal path to a second signal path, the method comprising:

positioning a first layer with a first conductor and a slot on a first surface, wherein a signal carried on the first conductor induces a plurality of field lines, the first conductor defining the first signal path;

positioning a second layer abutting the first surface of the first layer, the second layer having a first surface in operable communication with the first surface of the first layer, a second surface for communicating with a second signal path, and an opening for signal propagation between the first signal path and the second signal path; and positioning the second signal path abutting the second surface of the second layer; said second signal path at a right angle to a plane of the second surface, wherein a signal carried on the second signal path induces a plurality of field lines, the second signal path having a plurality of field lines, the plurality of field lines of the second signal path are aligned with the plurality of field lines of the first conductor.

21. The method of claim 20, comprising abutting a backshort to the second surface of the first layer.

22. The method of claim 20, wherein the first signal path carries a W-band signal from a back plane distribution network in an antenna array.

23. The method of claim 20, wherein the first signal path carries a millimeter wave band signal from a back plane distribution network in an antenna array.

24. The method of claim 20, wherein the first signal path carries a microwave wave band signal from a back plane distribution network in an antenna array.

* * * * *

UNITED STATES PATENT AND TRADEMARK OFFICE

CERTIFICATE OF CORRECTION

PATENT NO. : 6,512,431 B2
DATED : January 28, 2003
INVENTOR(S) : Albert Pergande It is certified that error appears in the above-identified patent and that said Letters Patent is hereby corrected as shown below:

Column 8,
Lines 21-22, delete "wherein α is in the range 80-100º" and insert therefor -- wherein α is 0º --.

Signed and Sealed this

First Day of July, 2003

JAMES E. ROGAN
*Director of the United States Patent and Trademark Office*